US007726401B2

(12) United States Patent
Parlin et al.

(10) Patent No.: US 7,726,401 B2
(45) Date of Patent: Jun. 1, 2010

(54) CASING EXIT JOINT WITH EASILY MILLED, LOW DENSITY BARRIER

(75) Inventors: Joseph D. Parlin, Plano, TX (US); William W. Dancer, Little Elm, TX (US); Jody R. McGlothen, Waxahachie, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 12/124,895

(22) Filed: May 21, 2008

(65) Prior Publication Data

US 2009/0288817 A1 Nov. 26, 2009

(51) Int. Cl.
*E21B 29/06* (2006.01)
*E21B 43/00* (2006.01)

(52) U.S. Cl. ..... 166/298; 166/313; 166/50; 166/117.5

(58) Field of Classification Search ..... 166/298, 166/313, 50, 117.5; 175/42
See application file for complete search history.

(56) References Cited

U.S. PATENT DOCUMENTS 2,007,465 A * 7/1935 Burt ..... 175/42
4,671,367 A 6/1987 Brunsing et al.
5,462,120 A * 10/1995 Gondouin ..... 166/380
5,787,978 A 8/1998 Carter et al.
5,875,847 A * 3/1999 Forsyth ..... 166/313
5,992,524 A 11/1999 Graham
6,012,527 A 1/2000 Nitis et al.
6,041,855 A 3/2000 Nistor
6,206,111 B1 3/2001 Nistor
6,308,782 B1 10/2001 Brooks et al.
6,913,082 B2 7/2005 McGlothen et al.
6,935,422 B2 8/2005 Steele et al.
2002/0056572 A1 * 5/2002 Hanton et al. ..... 175/73
2004/0026090 A1 2/2004 McGlothen et al.
2004/0146367 A1 7/2004 Gerhardt et al.
2004/0168807 A1 9/2004 McGlothen et al.

(Continued)

FOREIGN PATENT DOCUMENTS

WO 9809053 A2 3/1998

OTHER PUBLICATIONS

Sperry-Sun Drilling Services of Canada, Window Assembly L80 drawing No. 101438996, 2 pages, dated Jul. 29, 2005.

(Continued)

*Primary Examiner*—Giovanna C Wright
(74) *Attorney, Agent, or Firm*—Marlin R. Smith

(57) ABSTRACT

A casing exit joint with an easily milled and low density barrier. A casing exit joint for use in drilling a lateral wellbore outwardly from a parent wellbore includes a generally tubular window structure having a window formed through a sidewall of the structure. An outer sleeve is disposed external to the window structure, so that the sleeve overlies the window. A hardenable substance supports the sleeve against deflection toward the window. A method of drilling a lateral wellbore extending outwardly from a parent wellbore includes the steps of: providing a casing exit joint including a hardenable substance positioned in a sidewall of the casing exit joint; then installing the casing exit joint in the parent wellbore; and then cutting through the hardenable substance in order to provide access for drilling the lateral wellbore.

20 Claims, 4 Drawing Sheets

U.S. PATENT DOCUMENTS

2007/0181304 A1 8/2007 Rankin et al.

OTHER PUBLICATIONS

Halliburton Fluid Systems, "Cementing: Trophy Seal™ Floating Equipment," 2 pages, dated May 2005.
Halliburton Fluid Systems, "Cementing Super Seal II® Floating Equipment," 4 pages, dated Oct. 2006.
Sperry-Sun Drilling Services of Canada, Window Assembly L80 drawing No. 285445, 1 page, undated.
Halliburton Production Optimization, "Completion Tools: Mirage® Disappearing Plug and Autofill Sub," 2 pages, dated Aug. 2005.
Halliburton Sperry Drilling Services, "SperryRite® Advanced Reservoir Drainage Services," 2 pages, dated Sep. 2007.
SPE International, IADC/SPE 39367, "Improving Multilateral Drilling and Completion Efficiency with a Hollow Whipstock," 12 pages, dated 1998.
Halliburton Sperry Drilling Services, "SperryRite® Advanced Reservoir Drainage Services," 2 pages, Sep. 2007.
International Search Report and Written Opinion issued Jun. 26, 2009, for International Patent Application Serial No. PCT/US09/43074, 7 pages.
International Search Report and Written Opinion issued Jul. 6, 2009, for International Patent Application Serial No. PCT/US09/43097, 7 pages.
Office Action issued Sep. 4, 2009, for U.S. Appl. No. 12/124,810, 16 pages.

* cited by examiner

CASING EXIT JOINT WITH EASILY MILLED, LOW DENSITY BARRIER

BACKGROUND

The present disclosure relates generally to operations performed and equipment utilized in conjunction with a subterranean well and, in an embodiment described herein, more particularly provides a casing exit joint with an easily milled and low density barrier.

The milling of casing in a subterranean well in order to form a branch or lateral wellbore results in debris from the milling operation. Due to a density of the debris and a susceptibility of such debris to become magnetized as a result of the milling operation, the debris can be difficult to remove from the well. If the debris is left in the well, it can foul downhole equipment and prevent proper operation of the equipment. However, if the debris is circulated out of the well, it can foul surface equipment.

In order to make the milling debris easier to remove, a window is sometimes cut through a casing joint (known as a "pre-milled" window) prior to installing the casing joint in the well. The joint may be provided with an outer aluminum sleeve and seals to serve as a pressure barrier for, and to prevent fluid communication through, the window. The sleeve can also provide additional strength to the casing joint, for example, to compensate for the removal of the window material, and to transmit torque through the casing joint.

Aluminum is relatively easily milled through as compared to steel (from which the remainder of the casing joint is typically made), and aluminum does not become magnetized during the milling operation. However, aluminum's strength begins decreasing at a lower temperature compared to steel, and aluminum's strength decreases at a faster rate as compared to steel. This reduction in strength can occur before a casing or liner string with a pre-milled window has been isolated from pressure or secured via cementing operations or subsequent well operations.

Therefore, it will be appreciated that improvements are needed in the art of constructing casing exit joints, and in the associated art of drilling a lateral wellbore outwardly from a parent wellbore.

SUMMARY

In the present specification, casing exit joints and associated methods are provided which solve at least one problem in the art. One example is described below in which an outer sleeve is supported by a hardenable substance (such as cement). Another example is described below in which an inner support structure (such as a hardenable substance and/or an inner easily millable sleeve) can be cut through in order to drill a lateral wellbore.

In one aspect, a casing exit joint for use in drilling a lateral wellbore outwardly from a parent wellbore is provided. The casing exit joint includes a generally tubular window structure having a window formed through a sidewall of the structure. An outer sleeve is disposed external to the window structure, so that the sleeve overlies the window. A hardenable substance supports the sleeve against deflection toward the window.

In another aspect, a method of drilling a lateral wellbore extending outwardly from a parent wellbore is provided. The method includes the steps of: providing a casing exit joint including a hardenable substance positioned in a sidewall of the casing exit joint; then installing the casing exit joint in the parent wellbore; and then cutting through the hardenable substance in order to provide access for drilling the lateral wellbore.

These and other features, advantages, benefits and objects will become apparent to one of ordinary skill in the art upon careful consideration of the detailed description of representative embodiments hereinbelow and the accompanying drawings, in which similar elements are indicated in the various figures using the same reference numbers.

DETAILED DESCRIPTION

It is to be understood that the various embodiments described herein may be utilized in various orientations, such as inclined, inverted, horizontal, vertical, etc., and in various configurations, without departing from the principles of the present disclosure. The embodiments are described merely as examples of useful applications of the principles of the disclosure, which are not limited to any specific details of these embodiments.

In the following description of the representative embodiments of the disclosure, directional terms, such as "above", "below", "upper", "lower", etc., are used for convenience in referring to the accompanying drawings. In general, "above", "upper", "upward" and similar terms refer to a direction toward the earth's surface along a wellbore, and "below", "lower", "downward" and similar terms refer to a direction away from the earth's surface along the wellbore.

Figure 1:
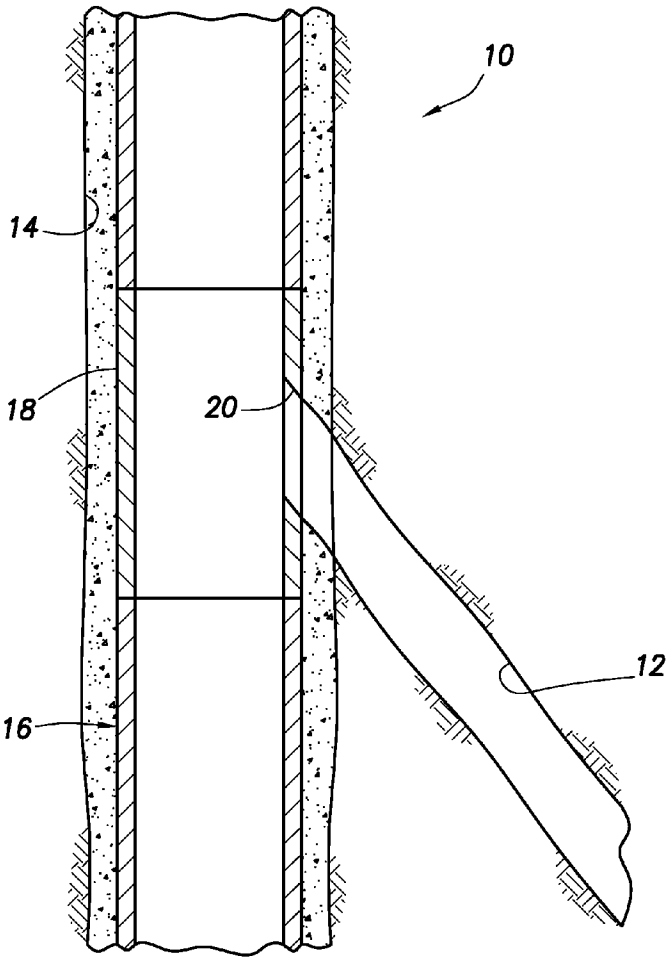
FIG. 1 is a schematic cross-sectional view of a well system embodying principles of the present disclosure.

Representatively illustrated in FIG. 1 is a well system 10 which embodies principles of the present disclosure. In the system 10, a branch or lateral wellbore 12 is drilled outwardly from a main or parent wellbore 14. For this purpose, a casing string 16 installed in the parent wellbore 14 includes a casing exit joint 18.

As used herein, the terms "casing, "casing string" and similar terms refer to a generally tubular protective lining for a wellbore. Casing can be made of any material, and can include tubulars known to those skilled in the art as casing, liner and tubing. Casing can be expanded downhole, interconnected downhole and/or formed downhole in some cases.

Note that the term "casing exit joint" is not meant to require that an exit joint have a length equivalent to a joint of casing. Instead, a casing exit joint can have any length suitable for interconnection as part of a casing string, and for installation in a well.

A window 20 provides access and fluid communication between the lateral and parent wellbores 12, 14. The window 20 may be formed through a sidewall portion of the casing exit joint 18 either before or after the casing exit joint is installed in the parent wellbore 14 (i.e., the window may be pre-milled or may be formed downhole).

As described more fully below, the casing exit joint 18 is uniquely constructed in a manner which solves singly, or in combination, the problems of reducing debris in the process of drilling the lateral wellbore 12, preventing magnetization of the debris, removing the debris from the well, preventing fluid flow through the window 20 prior to the lateral wellbore drilling operation (i.e., providing a pressure barrier for the casing exit joint sidewall) and providing the casing exit joint with sufficient tensile, compressive and torsional strength.

Figure 2:
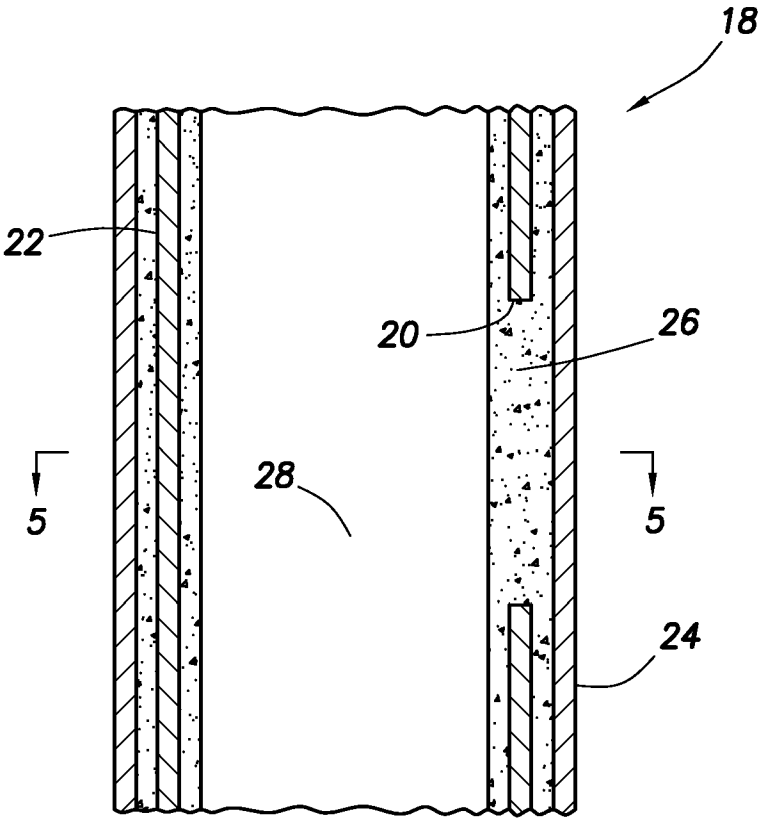
FIG. 2 is an enlarged scale schematic cross-sectional view through a casing exit joint which may be used in the well system of FIG. 1, the casing exit joint embodying principles of the present disclosure.

Referring additionally now to FIG. 2, one example of the casing exit joint 18 embodying principles of the present disclosure is representatively illustrated apart from the remainder of the well system 10. In this example, the window 20 is pre-milled through a sidewall of a generally tubular window structure 22. In addition, an outer sleeve 24 outwardly surrounds the window structure 22, overlying the window 20.

The window structure 22 is preferably made of a high strength material (such as steel), and the outer sleeve 24 is preferably made of a relatively low density, easily milled and nonmagnetic material (such as an aluminum alloy or a composite material). However, it should be clearly understood that other materials may be used in keeping with the principles of this disclosure.

In one unique feature of the casing exit joint 18, a hardenable substance 26 is used to outwardly support the outer sleeve 24 and otherwise contribute to the strength of the casing exit joint. In particular, the hardenable substance 26 prevents the outer sleeve 24 from deflecting inwardly, for example, due to external pressure. The hardenable substance 26 also provides increased rigidity to the structure of the casing exit joint 18, thereby increasing its tensile, compressive and torsional strength.

The hardenable substance 26 may comprise various materials which harden to a solid state from a flowable state. For example, the hardenable substance 26 may be a cement or include a cementitious material, or the hardenable substance could include an epoxy, other polymers, etc. Preferably, the hardenable substance 26 is in a flowable state when it is incorporated into the casing exit joint 18, so that it can easily flow into various spaces in the casing exit joint prior to hardening.

The outer sleeve 24 may be considered to comprise a laminate of the hardenable substance 26 and the easily milled material, since these materials are layered on the window structure 22.

As depicted in FIG. 2, the hardenable substance 26 is positioned in the window 20, in an annular space between the window structure 22 and the outer sleeve 24, and within the window structure. It is not necessary for the hardenable substance 26 to occupy all of these areas in keeping with the principles of this disclosure, but this configuration is preferred for providing sufficient strength and pressure isolation to the casing exit joint 18.

Note that, in the configuration of FIG. 2, the hardenable substance 26 is exposed to an inner longitudinal flow passage 28 formed through the casing exit joint 18. Indeed, the hardenable substance 26 forms an outer boundary of the flow passage 28.

Figure 3:
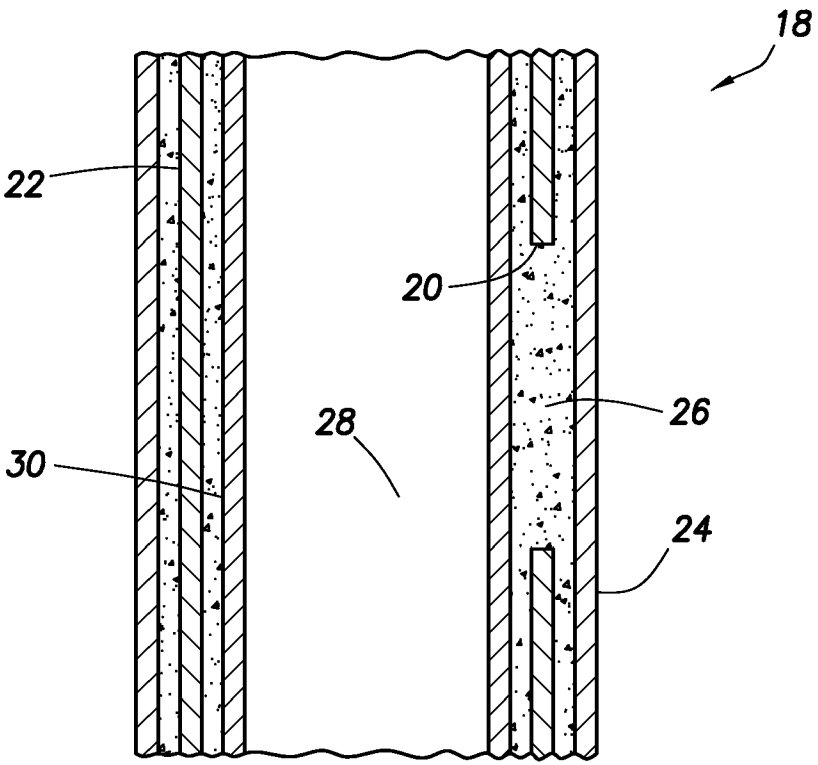
FIG. 3 is a schematic cross-sectional view of another configuration of the casing exit joint.

In another configuration of the casing exit joint 18 representatively illustrated in FIG. 3, however, an inner sleeve 30 is positioned within the window structure 22 and forms an outer boundary of the flow passage 28. The inner sleeve 30 is preferably made of a material similar to that of the outer sleeve 24. The inner sleeve 30 provides increased strength to the casing exit joint 18, serves to contain the hardenable substance 26 prior to its hardening, and is a protective inner lining for the hardenable substance.

The inner sleeve 30 may also be considered to comprise a laminate of the hardenable substance 26 and the easily milled material.

Figure 4:
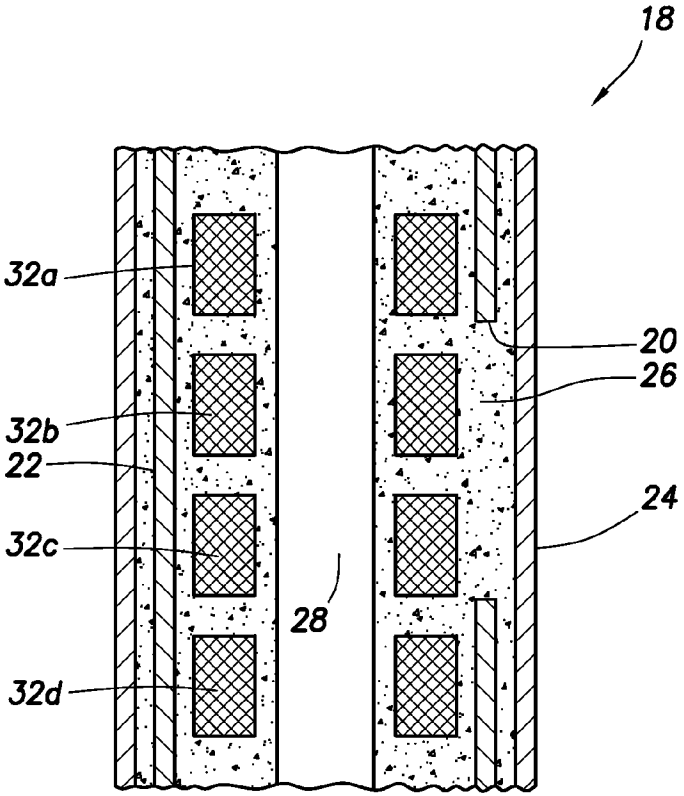
FIG. 4 is a schematic cross-sectional view of another configuration of the casing exit joint.

Referring additionally now to FIG. 4, another configuration of the casing exit joint 18 is representatively illustrated. In this configuration, multiple annular cavities 32*a-d* are provided in the hardenable substance 26.

The cavities 32*a-d* are longitudinally spaced apart, and a different color material is contained within each of the cavities. During the operation of cutting through the hardenable substance 26 in order to drill the lateral wellbore 12, a cutting tool (such as a drill or mill) will cut into one or more of the cavities 32*a-d* and the corresponding colored material will be circulated to the surface with a fluid which is circulated through a drill string.

By observing which colored material appears at the surface, an observer can determine where the cutting tool is penetrating the hardenable substance 26. This indication can confirm that the cutting operation is proceeding as expected, or corrections can be made to the cutting operation as needed.

Figure 5:
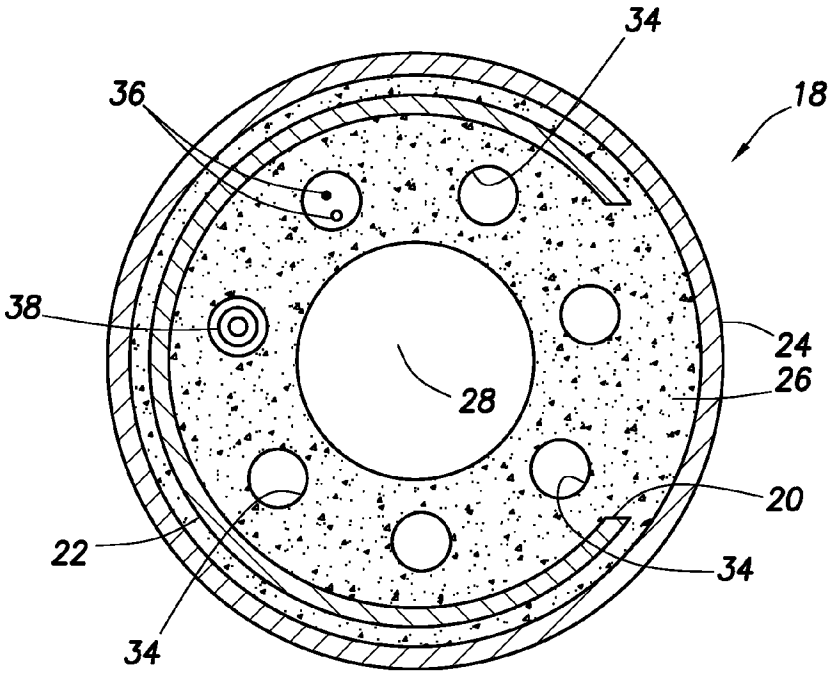
FIG. 5 is an enlarged scale schematic cross-sectional view of another configuration of the casing exit joint, taken along line 5-5 of FIG. 2.

Referring additionally now to FIG. 5, another configuration of the casing exit joint 18 is representatively illustrated. FIG. 5 is an enlarged scale section taken along line 5-5 of FIG. 2, but with additional features added to the casing exit joint 18.

Specifically, additional longitudinally extending passages 34 are formed through the hardenable substance 26. These passages 34 provide additional fluid conduits, provide for extending lines 36 (such as electrical, communication, fiber optic, hydraulic, etc. lines) through the casing exit joint 18 and/or provide for extending one or more conduits 38 through the casing exit joint.

Although the passages 34 are depicted in FIG. 5 as being positioned internal to the window structure 22, they could instead, or in addition, be positioned between the window structure and the outer sleeve 24, positioned between the window structure and an inner sleeve (such as the inner sleeve 30, if provided in this configuration), or otherwise positioned.

Figure 6:
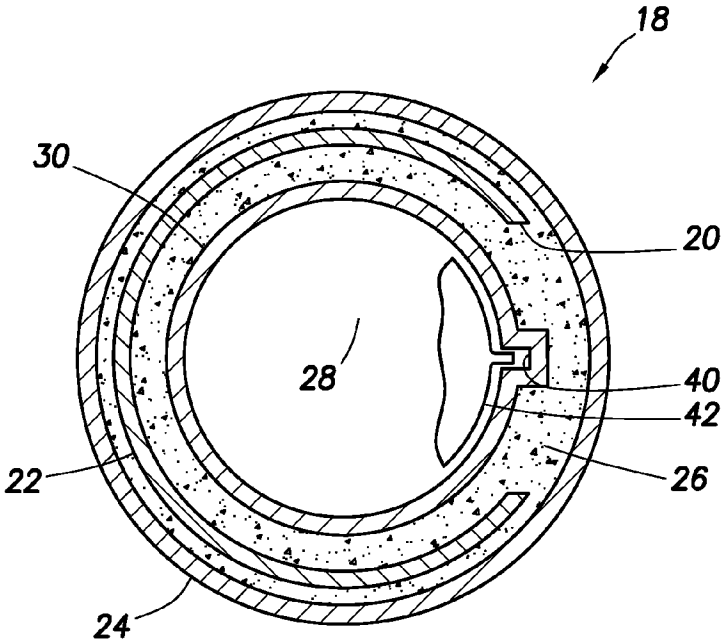
FIG. 6 is a schematic cross-sectional view of another configuration of the casing exit joint.

Referring additionally now to FIG. 6, another configuration of the casing exit joint 18 is representatively illustrated. In this configuration, an internal profile 40 is formed in the inner sleeve 30 for use in azimuthally orienting the casing exit joint 18.

During installation of the casing exit joint 18, an orientation sensing tool 42 (such as a conventional measurement-while-drilling tool, gyro or a conventional low side or high side detector, etc.) is engaged with the internal profile 40, so that the tool is in a known position relative to the window 20. In this manner, the casing exit joint 18 can be properly oriented, so that the lateral wellbore 12 can be drilled in a desired direction through the window 20.

Figure 7:
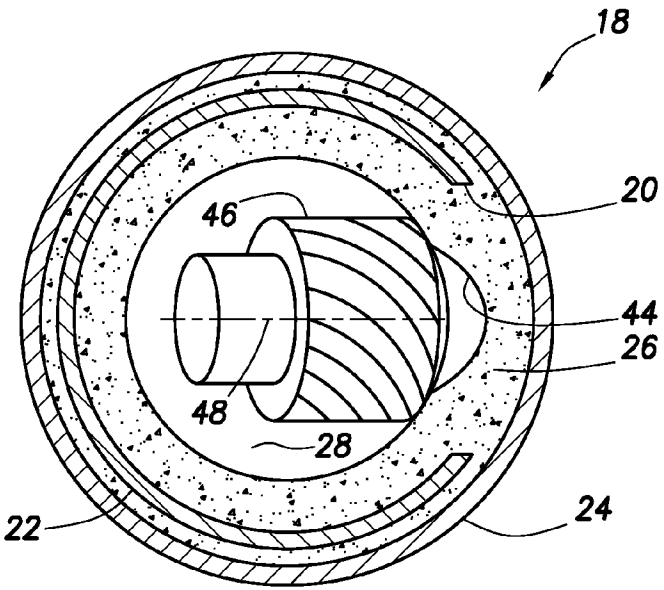
FIG. 7 is a schematic cross-sectional view of another configuration of the casing exit joint.

Instead of forming the profile 40 in the inner sleeve 30, the profile could be formed in the hardenable substance 26 (e.g., if the inner sleeve is not provided in the casing exit joint 18). As depicted in FIG. 7, other types of profiles may also be formed in the hardenable substance 26 or inner sleeve 30.

In FIG. 7, an internal profile 44 is used to prevent, or at least resist, lateral displacement of a cutting tool 46 relative to a longitudinal axis 48 of the cutting tool. This helps to prevent the cutting tool 46 from "walking" in a direction of its rotation while it cuts through the hardenable substance 26 and outer sleeve 24 (and inner sleeve 30, if provided in the casing exit joint 18). Similar internal profiles are described in copending patent application Ser. No. 12/124810, filed May 21, 2008, the entire disclosure of which is incorporated herein by this reference.

Figure 8:
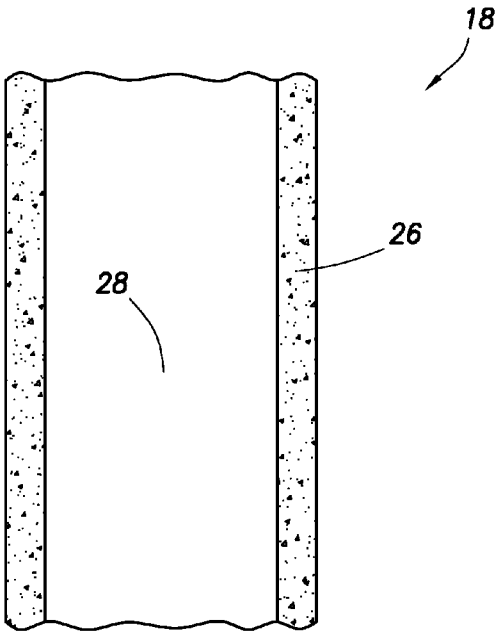
FIG. 8 is a schematic cross-sectional view of another configuration of the casing exit joint.

Referring additionally now to FIG. 8, another configuration of the casing exit joint 18 is representatively illustrated. In this configuration, the entire sidewall of the casing exit joint 18 is made up of the hardenable substance 26.

The hardenable substance 26 in this configuration may include strength-enhancing materials (such as one or more metals, carbon or glass fibers, a polymer matrix, etc.) in addition to the flowable cement or other material. The casing exit joint 18 sidewall could instead, or in addition, be made up of layers of composite materials, cement and/or other materials.

Note that, in this configuration, the window 20 is not premilled in any portion of the casing exit joint 18 sidewall. This eliminates the need to azimuthally orient the casing exit joint 18 during installation in the parent wellbore 14. However, due to the unique construction of the casing exit joint 18, the objectives of reducing debris in the process of drilling the lateral wellbore 12, preventing magnetization of the debris, removing the debris from the well, preventing fluid flow through the window 20 prior to the lateral wellbore drilling operation (i.e., providing a pressure barrier for the casing exit joint sidewall) and providing the casing exit joint with sufficient tensile, compressive and torsional strength are accomplished.

It may now be fully appreciated that significant advancements in the arts of constructing casing exit joints and drilling lateral wellbores are provided by the present disclosure. In particular, by using relatively low density and easily millable/drillable materials, but providing sufficient strength for installing and cementing a casing string in a well, the casing exit joints described above solve a number of problems associated with debris generated during the milling/drilling operations, while also enabling conventional methods to be used for installing and cementing the casing string.

The above disclosure provides a casing exit joint 18 for use in drilling a lateral wellbore 12 outwardly from a parent wellbore 14. The casing exit joint 18 includes a generally tubular window structure 22 having a window 20 formed through a sidewall of the structure. An outer sleeve 24 is disposed external to the window structure 22, so that the sleeve overlies the window 20. A hardenable substance 26 supports the sleeve 24 against deflection toward the window 20.

The hardenable substance 26 may be disposed at least in the window 20. The hardenable substance 26 may be disposed at least between the outer sleeve 24 and the window structure 22.

The casing exit joint 18 may also include an inner sleeve 30 disposed internal to the window structure 22. The hardenable substance 26 may be disposed at least between the inner and outer sleeves 24, 30.

The hardenable substance 26 may include cement. A flow passage 28 may extend longitudinally through the hardenable substance and provide fluid communication between opposite ends of the casing exit joint 18. A line 36 may extend through a passage 34 formed longitudinally through the hardenable substance 26.

The inner sleeve 30 may comprise a laminate of the hardenable substance 26 and an easily milled material. The casing exit joint 18 may include a laminate of the hardenable substance 26 and an easily milled material. The outer sleeve 24 may comprise a laminate of the hardenable substance 26 and an easily milled material.

The above disclosure also provides a method of drilling a lateral wellbore 12 extending outwardly from a parent wellbore 14. The method includes the steps of: providing a casing exit joint 18 including a hardenable substance 26 positioned in a sidewall of the casing exit joint; then installing the casing exit joint 18 in the parent wellbore 14; and then cutting through the hardenable substance 26 in order to provide access for drilling the lateral wellbore 12.

A window 20 may or may not be formed through any portion of the casing exit joint 18 sidewall prior to the cutting step.

The hardenable substance 26 may be generally tubular shaped and may be disposed within an outer sleeve 24. The hardenable substance 26 may be disposed external to an inner sleeve 30. The installing step may include engaging an orientation sensing tool 42 with a profile 40 formed in the inner sleeve 30.

The cutting step may include engaging a cutting tool 46 with a profile 44 formed in the hardenable substance 26. Engagement between the cutting tool 46 and the profile 26 may resist lateral displacement of the cutting tool relative to a longitudinal axis 48 of the cutting tool.

The hardenable substance 26 may be disposed at least in a window 20 formed through a sidewall of a window structure 22 of the casing exit joint 18. The hardenable substance 26 may be disposed at least between the window structure 22 and an outer sleeve 24 which overlies the window 20.

The casing exit joint 18 may include an inner sleeve 30 disposed internal to the window structure 22, and the hardenable substance 26 may be disposed at least between the inner and outer sleeves 24, 30.

The method may include flowing a fluid through a flow passage 28 which extends longitudinally through the hardenable substance 26 and provides fluid communication between opposite ends of the casing exit joint 18. The method may include extending a line 36 through a passage 34 formed longitudinally through the hardenable substance 26.

Multiple longitudinally distributed cavities 32*a-d* in the hardenable substance 26 may have respective differently colored materials therein. The cutting step may include observing arrival of the colored materials at the surface as an indication of corresponding progress of cutting through the hardenable substance 26.

Of course, a person skilled in the art would, upon a careful consideration of the above description of representative embodiments, readily appreciate that many modifications, additions, substitutions, deletions, and other changes may be made to these specific embodiments, and such changes are within the scope of the principles of the present disclosure. Accordingly, the foregoing detailed description is to be clearly understood as being given by way of illustration and example only, the spirit and scope of the present invention being limited solely by the appended claims and their equivalents.

What is claimed is:

1. A casing exit joint for use in drilling a lateral wellbore outwardly from a parent wellbore, the casing exit joint comprising:

a generally tubular window structure having a window formed through a sidewall of the structure;

an outer sleeve disposed external to the window structure, so that the sleeve overlies the window; and a hardenable substance disposed in the window and in an annulus between the window structure and the outer sleeve, the hardenable substance supporting the sleeve against deflection toward the window.

2. The casing exit joint of claim 1, further comprising an inner sleeve disposed internal to the window structure, and wherein the hardenable substance is disposed between the inner and outer sleeves.

3. The casing exit joint of claim 2, wherein the inner sleeve comprises a laminate of the hardenable substance and an easily milled material.

4. The casing exit joint of claim 1, wherein the hardenable substance comprises cement.

5. The casing exit joint of claim 1, wherein a flow passage extends longitudinally through the hardenable substance and provides fluid communication between opposite ends of the casing exit joint.

6. The casing exit joint of claim 1, wherein a line extends through a passage formed longitudinally through the hardenable substance.

7. The casing exit joint of claim 1, further comprising a laminate of the hardenable substance and an easily milled material.

8. The casing exit joint of claim 1, wherein the outer sleeve comprises a laminate of the hardenable substance and an easily milled material.

9. A method of drilling a lateral wellbore extending outwardly from a parent wellbore, the method comprising the steps of:

providing a casing exit joint including a hardenable substance positioned in a sidewall of the casing exit joint;

then installing the casing exit joint in the parent wellbore, without a window being previously provided in any portion of the casing exit joint; and then cutting through the hardenable substance in order to provide access for drilling the lateral wellbore.

10. The method of claim 9, wherein the installing step further comprises engaging an orientation sensing tool with a profile formed in the hardenable substance.

11. The method of claim 9, wherein in the providing step, the hardenable substance is generally tubular shaped and is disposed within an outer sleeve.

12. The method of claim 9, wherein in the providing step, the hardenable substance is generally tubular shaped and is disposed external to an inner sleeve.

13. The method of claim 12, wherein the installing step further comprises engaging an orientation sensing tool with a profile formed in the inner sleeve.

14. The method of claim 12, wherein the cutting step further comprises engaging a cutting tool with a profile formed in the inner sleeve, engagement between the cutting tool and the profile resisting lateral displacement of the cutting tool relative to a longitudinal axis of the cutting tool.

15. The method of claim 9, wherein the cutting step further comprises engaging a cutting tool with a profile formed in the hardenable substance, engagement between the cutting tool and the profile resisting lateral displacement of the cutting tool relative to a longitudinal axis of the cutting tool.

16. The method of claim 9, wherein in the providing step, the casing exit joint further comprises an inner sleeve disposed internal to the window structure, and wherein the hardenable substance is disposed at least between the inner sleeve and an outer sleeve which overlies the window.

17. The method of claim 9, wherein in the providing step, the hardenable substance comprises cement.

18. The method of claim 9, further comprising the step of flowing a fluid through a flow passage which extends longitudinally through the hardenable substance and provides fluid communication between opposite ends of the casing exit joint.

19. The method of claim 9, further comprising the step of extending a line through a passage formed longitudinally through the hardenable substance.

20. The method of claim 9, wherein in the providing step, multiple longitudinally distributed cavities in the hardenable substance have respective differently colored materials therein, and wherein the cutting step further comprises observing arrival of the colored materials at the surface as an indication of corresponding progress of cutting through the hardenable substance.

* * * * *